US008651311B1

(12) United States Patent
Drummond et al.

(10) Patent No.: US 8,651,311 B1
(45) Date of Patent: Feb. 18, 2014

(54) MEASURING SCOOP AND SUPPORT FOR A CONTAINER

(71) Applicant: Sonoco Development, Inc., Hartsville, SC (US)

(72) Inventors: Michael T. Drummond, Laurinburg, NC (US); Kurt Ziegenfelder, Florence, SC (US); Veronique Sins, Grimberger (BE)

(73) Assignee: Sonoco Development, Inc., Hartsville, SC (US)

( * ) Notice: Subject to any disclaimer, the term of this patent is extended or adjusted under 35 U.S.C. 154(b) by 0 days.

(21) Appl. No.: 13/722,377

(22) Filed: Dec. 20, 2012

(51) Int. Cl.
*B65D 51/24* (2006.01)
*B65D 41/56* (2006.01)

(52) U.S. Cl.
USPC ..... 220/212; 206/223; 206/541; 220/796

(58) Field of Classification Search
USPC ..... 220/796, 212; 206/223, 541
See application file for complete search history.

(56) References Cited

U.S. PATENT DOCUMENTS

| | | | | |
|---|---|---|---|---|
| 700,653 | A | 5/1902 | Jobson | |
| 1,607,865 | A | 11/1926 | Butler | |
| 1,625,335 | A | 4/1927 | Schneider | |
| 1,703,185 | A | 2/1929 | White | |
| 1,768,771 | A | 7/1930 | La Tourrette | |
| 1,853,852 | A | 4/1932 | Estes | |
| D123,940 | S | 12/1940 | Worth et al. | |
| 2,789,608 | A | 4/1957 | Tupper | |
| 3,312,366 | A | 4/1967 | Poris | |
| 3,704,779 | A | 12/1972 | Nigg | |
| 3,722,779 | A | 3/1973 | Chang | |
| 3,955,742 | A | 5/1976 | Marshall et al. | |
| 4,432,466 | A | 2/1984 | Allen | |
| D302,793 | S | 8/1989 | Yamaguchi | |
| 5,042,712 | A | 8/1991 | DeRoseau | |
| 5,222,622 | A * | 6/1993 | Laske, Jr. | 220/574.1 |
| 5,695,084 | A | 12/1997 | Chmela et al. | |
| 5,706,974 | A | 1/1998 | Murdick et al. | |
| 5,775,531 | A | 7/1998 | Lowry | |
| D416,438 | S | 11/1999 | Molo | |
| 5,992,667 | A | 11/1999 | Huang | |
| 6,003,710 | A | 12/1999 | Huang | |
| 6,116,450 | A | 9/2000 | Huang | |
| 6,604,646 | B2 | 8/2003 | Torniainen et al. | |
| D483,988 | S | 12/2003 | Kipperman et al. | |
| 7,040,500 | B2 | 5/2006 | Kipperman et al. | |
| 7,175,041 | B2 | 2/2007 | Ekkert | |
| 7,370,788 | B1 | 5/2008 | Otani et al. | |
| 7,464,475 | B2 | 12/2008 | Tsao | |
| 7,503,464 | B2 * | 3/2009 | McCain | 220/574.1 |
| 7,562,786 | B2 | 7/2009 | Morrison | |
| D602,775 | S | 10/2009 | Shale | |
| 7,823,743 | B2 | 11/2010 | McKahan et al. | |

(Continued)

*Primary Examiner* — Mickey Yu
*Assistant Examiner* — Niki Eloshway
(74) *Attorney, Agent, or Firm* — Flaster/Greenberg, P.C.

(57) ABSTRACT

In insert is provided for use with a container and for positioning in the container opening. The insert includes a body having an outer periphery dimensioned for receipt within container opening. A utensil is frangibly secured to the insert body within an internal open area. A receiving tab is provided that projects from the body into the open area. An engagement structure is formed on the utensil and on the receiving tab. The engagement portions cooperate with one another for removably securing the utensil to the receiving tab after the frangible connection to the body is removed.

28 Claims, 6 Drawing Sheets

(56) References Cited

U.S. PATENT DOCUMENTS

| | | | |
|---|---|---|---|
| 7,909,204 | B2 | 3/2011 | Antal, Sr. |
| 7,971,747 | B2 | 7/2011 | Blomdahl et al. |
| 8,087,530 | B2 | 1/2012 | Stevens |
| D661,588 | S | 6/2012 | Irani et al. |
| 8,215,167 | B2 | 7/2012 | Hall |
| 2003/0029868 | A1 | 2/2003 | Davidov et al. |
| 2004/0094548 | A1 | 5/2004 | Laveault |
| 2004/0099566 | A1 | 5/2004 | Kipperman et al. |
| 2008/0156808 | A1 | 7/2008 | Perry et al. |
| 2013/0001227 | A1* | 1/2013 | Groubert ..... 220/212 |

* cited by examiner

MEASURING SCOOP AND SUPPORT FOR A CONTAINER

FIELD OF THE INVENTION

The present disclosure relates to an insert for supporting a measuring scoop or other utensil in combination with a container.

BACKGROUND

Containers for storing a product, such as a liquid, a powder or granular materials, are known. The form of a container is often varied to provide for delivery of the product, in sealing the product or aesthetic reasons. Structures for dispensing the product from a container are known, including scoops for measuring a desired quantity of the product.

It is known to provide a measuring scoop with a container or on a closure lid structure. US D661,588 to Irani et al shows a measuring scoop mounted to the underside of a pivotable container lid.

U.S. Pat. No. 7,971,747 to Blomdahl et al shows a container closure having two pivotable parts and a separable scoop structure.

U.S. Pat. No. 5,775,531 top Lowry shows a container having a closure rim with an inwardly directed flange. A membrane seal is removably attached to the flange and a scoop structure is detachably secured to the underside of the membrane seal.

SUMMARY OF THE INVENTION

In one aspect of the present disclosure, an insert is provided for use with a container. The container may be of the type having an interior volume where a product is stored and an opening therein for providing access to the product. The container opening may be defined by a peripheral rim having an internal sidewall. The insert includes a body portion defining an outer periphery and an internal open area. The outer periphery includes a defined dimension for receipt of the insert within the internal sidewall of the container rim. The utensil is frangibly secured to the body within the internal area. The utensil initially extends across at least a portion of the open area. A receiving tab projects from the body into the open area. Frictional engagement means is formed on the utensil and on the receiving tab. The engagement portions cooperate with one another for removably securing the utensil to the receiving tab. The utensil is frangibly connected to the body. The frangible connection may be structurally ruptured in response to application of a sufficient force between the body and the utensil for removal of the utensil. The utensil is secondarily secured to the receiving tab by the frictional engagement means. The utensil is preferably frangibly connected to the insert body at two spaced locations.

In a further aspect of the disclosure, the utensil is in the form of a scoop having a handle portion and a utility portion in the form of a bowl. The bowl of the scoop may be defined with a fixed volume for measuring a desired quantity of project. The bowl is defined by a top opening lip, tapered sidewalls, and a bottom surface. The handle preferably extends from the utility portion, with the two defining a linear length of the utensil, with the linear length of the utensil being substantially equal to a transverse dimension of the open area of the body, such that the utensil extends across the open area and is frangibly connected at opposite ends.

In a further aspect of the disclosure, the utensil may be frangibly connected to the body at one end and frangibly connected to the receiving tab at an opposite end. Preferably, the body, tab and utensil are integrally molded from a polymeric material. The frangible connections preferably comprise a reduced cross-sectional thickness of said polymeric material between the utensil and the connection to the body.

In a still further aspect of the disclosure, a leveling bar may be provided. The leveling bar is preferably connected to the body of the insert and extends across the open area adjacent the utensil.

In a further aspect of the disclosure, the frictional engagement means comprises a projecting tag and a receiving opening. The projecting tag is formed for frictional engagement within the receiving opening. As an example, the receiving opening may be formed on the receiving tab and the cooperating projecting tag may be formed on the utensil.

In a further aspect of the disclosure, the body may be formed as a ring, with the ring having an outside sidewall defining the outer periphery and an inside wall with the open area defined therein. A projecting rim portion may be provided that extends outwardly from the outside wall. The rim portion may be adapted to engage the peripheral rim of the container for positioning the body within the container opening. In a further aspect of the disclosure, the ring may be formed as a circle to match the form of a circular opening in the container. The outside wall of the ring may include frictional ribs for engagement of the body with the internal wall of the container opening.

In a further aspect of the disclosure, an insert and container combination is defined. The container includes a sidewall, a bottom wall and an opening surrounded by an upper rim. The sidewall and bottom wall define an interior volume where a product may be stored and the opening provides access to the product. An insert is provided with the container. The insert includes a planer body having an outer periphery and an internal open area. The outer periphery of the insert body is dimensioned to permit its receipt within the container rim. A scoop or other utensil is frangibly secured within the plane of the body. The scoop initially extends across at least a portion of the open area. The scoop preferably includes a handle portion projecting from a peripheral lip of an open bowl portion. A receiving tab is provided on the body of the insert and projects the open area within the plane of the body. An engagement means is cooperatively formed on the scoop handle and on the receiving tab. The engagement means provides for removable securing of the scoop to the receiving tab. The scoop is initially connected to the body within the open area and the frangible connection accommodates a rupture of the connection in response to application of a force to the scoop. The scoop is secondarily secured in the open area to the receiving tab by activation of the frictional engagement means.

In a further aspect of the disclosure, the scoop may be frangibly connected to the insert body at two spaced locations. Further, the body, tab and scoop of the insert are preferably integrally molded from a polymeric material. 20. The frangible connections are preferably formed by a reduced cross-sectional thickness of the material between the scoop and the connection to the insert body. One of the frangible connections of the scoop to the insert body may be formed as a connection to the receiving tab. Further, a leveling bar may also be connected to the body to extend across the open area. Preferably, the leveling bar is positioned adjacent and parallel to the scoop.

In a further aspect of the combination, the frictional engagement means may include a projecting tag and a receiving opening, wherein the projecting tag is formed for frictional engagement within the receiving opening. The receiving opening, for example, may be formed on the tab and the projecting tag is formed on the handle of the scoop. These structures may be reversed in position or otherwise modified.

In a further aspect of the combination, the insert body may be formed as a ring, with the ring having an outside sidewall defining the outer periphery and having an inside wall with the open area defined therein. The insert may further include a projecting rim portion extending outwardly from the outside wall. The projecting rim portion may be adapted to engage the upper rim of the container for positioning the insert body within the container opening. Further, the ring may include a circular form. In addition, frictional ribs or other structures may be provided for engagement of the inside surface of the sidewall of the container.

In a further aspect of the combination, an overcap may be provided for engaging the upper rim of the container and for closing the container opening. The overcap further covers the insert positioned within the opening of the container.

In a further aspect of the combination, a closure rim may be secured to the upper rim of the container. The closure rim may include an inwardly directed flange thereon. The insert may be cooperatively positioned on the flange within the opening of the container.

Other features of the present invention will become apparent from the detailed description to follow, taken in conjunction with the accompanying drawings.

BRIEF DESCRIPTION OF THE DRAWINGS

For illustrating the invention, the drawings show one or more forms that are presently preferred. It should be understood that the invention is not limited to the precise arrangements and instrumentalities shown.

DETAILED DESCRIPTION

Figure 1:
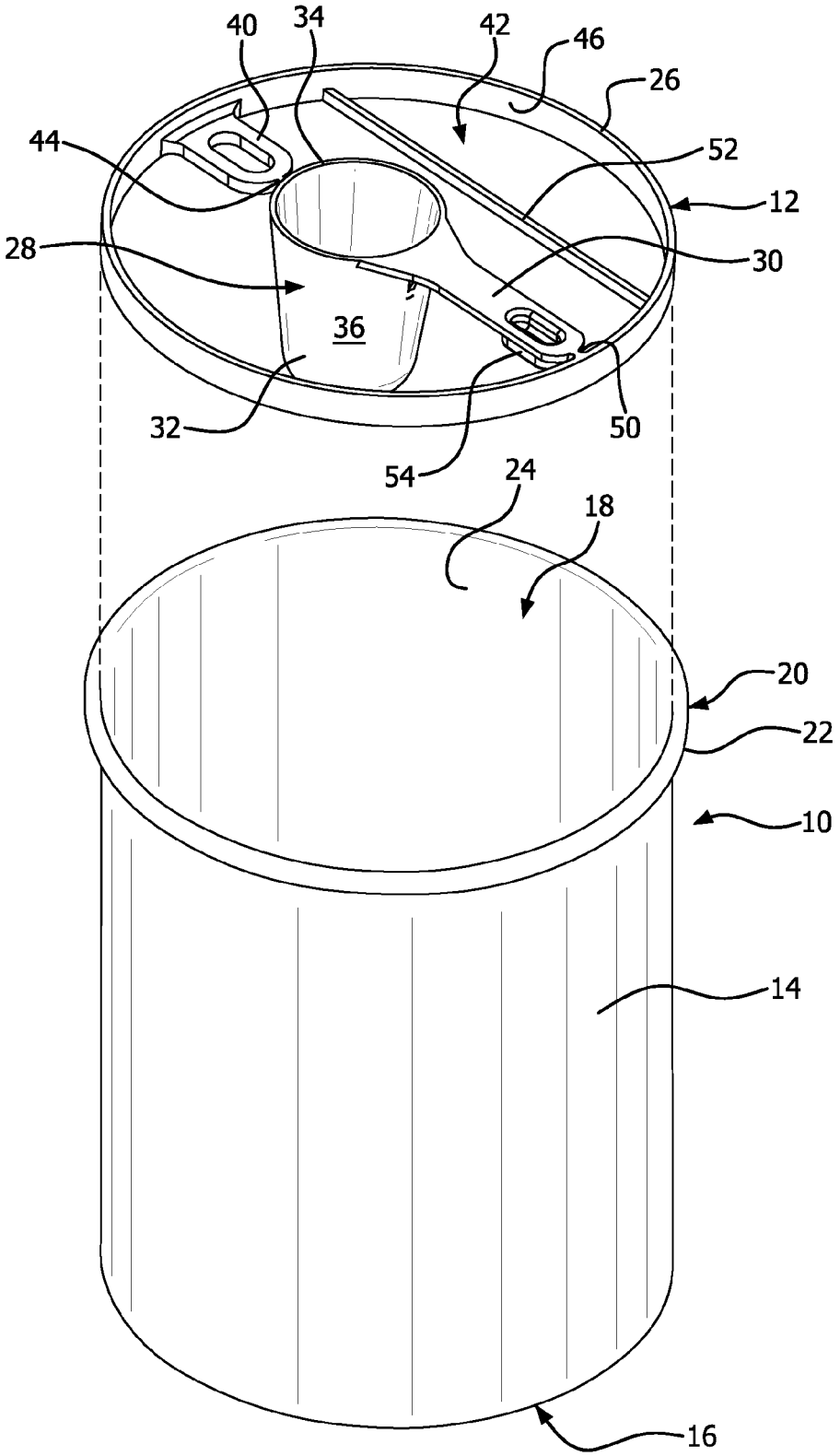
FIG. 1 is a perspective view of a container and an insert structure with the elements shown in an exploded position.

In the figures, where like numerals identify like elements, there is shown various combinations of a container and an insert structure. The insert structure supports a utensil, such as a measuring scoop, for use with the container. In FIG. 1, the container is generally identified by the numeral 10 and the insert structure is identified by the numeral 12. The container 10 is shown as a rounded can having a round sidewall 14 and a bottom wall 16. The sidewall 14 and bottom wall 16 define an interior volume where product (not shown) may be stored. A top opening 18 is provided in the container 10, opposite of the bottom wall 16. The container opening 18 is defined by a peripheral rim 20. The rim 20 includes a bead 22 that projects outwardly from the sidewall 14. An internal sidewall surface 24 is formed inside of the rim 20 and bead 22.

Figure 2:
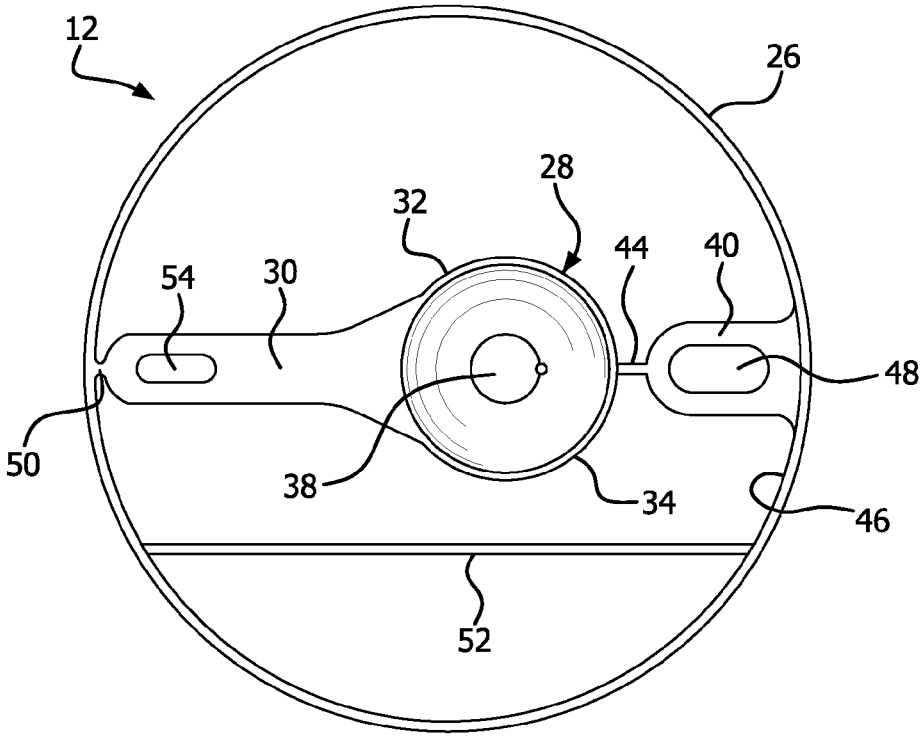
FIG. 2 shows a top plan view of the insert structure shown in FIG. 1.

The insert 12 shown in FIG. 1 (and as further shown in FIGS. 2-4) is separated from the container 10. The insert 12 includes a body portion 26 in the form of a ring. The ring of the body 26 is dimensioned such that its outer periphery can be received within the opening 18 of the container 10. In the embodiment of FIG. 1, it is contemplated that the outside dimension of the ring 26 will form a friction fit with the inside wall 24 of the container 10. This frictional relationship positions the insert 12 adjacent the rim 20 and maintains this positioning for further use of the utensil 28 formed as part of the insert 12. The utensil 28 is shown as a scoop having a handle 30 and a bowl 32. The bowl 32 has an open top defined by a lip 34, a tapered sidewall 36 and rounded bottom 38. Preferably, the volume of the bowl is formed to measure a useful quantity of product.

The scoop 28 is secured to the ring 26 within the open area 42 internally defined within the ring 26. The first connection 44 is created between the bowl 32 and an inwardly projecting tab 40. The tab 40 is connected at its base to the inside wall 46 of the ring 26. The tab further includes a receiving opening 48 therein. The second connection 50 for the utensil 28 is positioned directly opposite the tab 40 on the inside wall surface 46 of the ring 26. Positioned parallel to the utensil 28 is a leveling bar 52. The leveling bar 52 connected at opposite ends to the ring 26. The leveling bar 52 functions to remove excess product from within the bowl 32 of the scoop by scraping the lip 34 across the underside of the bar 52. Hence, the product retained within the bowl 32 is measured to the desired useful quantity.

Figure 3:
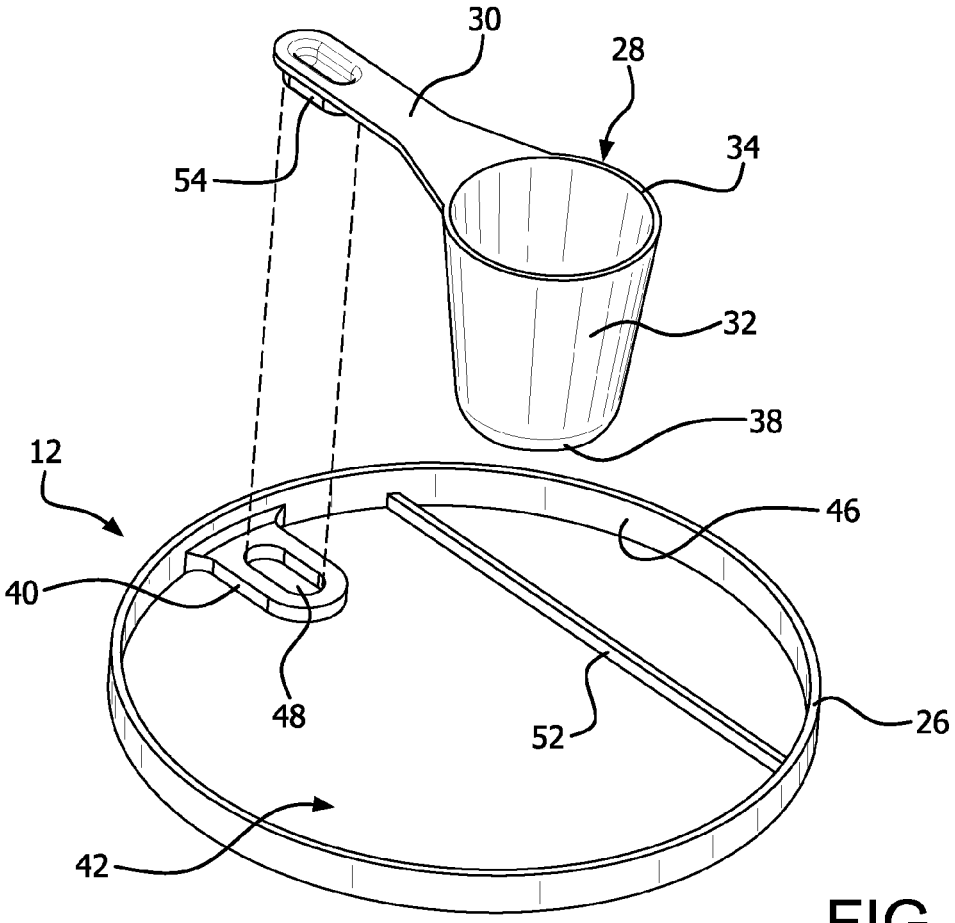
FIGS. 3 and 4 show perspective views of the insert structure in use.

The insert body 26, utensil 28, tab 40 and leveling bar 52 are contemplated to be integrally formed by an injection molding process using a polymeric material. The connections 44, 50 between the utensil 28 and the body 26 of the insert 12 are contemplated to be frangible, such that the utensil 28 may be removed from the body portion 26, as shown in FIG. 3. The frangible connections 44, 50 are formed by a reduced cross-sectional thickness in the material forming the insert 12. The utensil 28 may be separated by a sufficient removal force, such as a twisting motion, to break the connections 44, 50 with the inside wall 46 of the ring body portion 26 and the projecting tab 40. The base of the tab 40 is contemplated to have a relatively thick connection to the inside wall 46 of the ring body 26, providing a strong and relatively stiff connection that will not break under the application of the utensil removal force.

Figure 4:
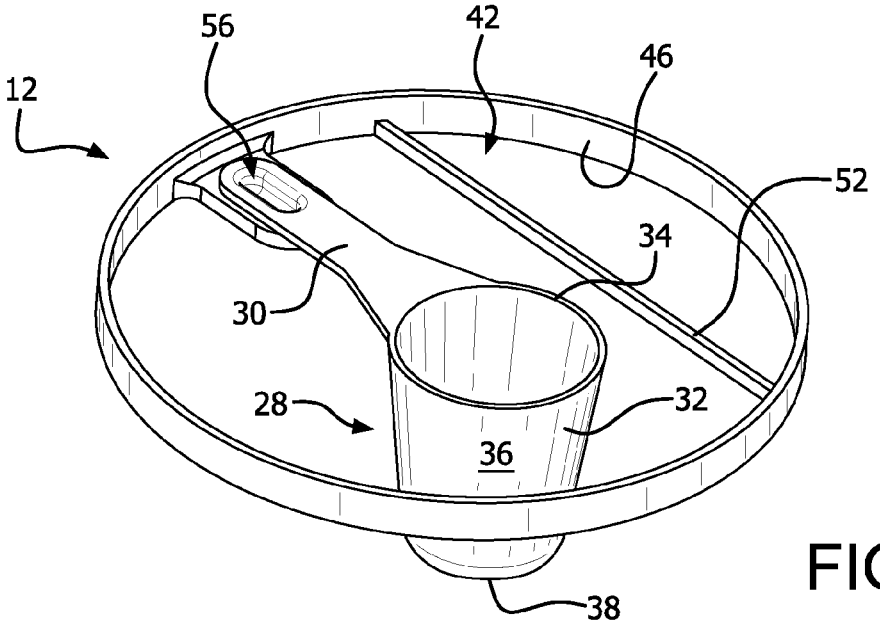

The handle 30 of the scoop utensil 28 is provided with a projecting tag 54. The tag 54 is formed with similar dimensions as the receiving opening 48, such that the tag 54 may form a frictional engagement within the opening 48. This frictional engagement between the tag 54 and opening 48 creates a means for secondarily securing the utensil 28 to the ring body 26. This secondary engagement is shown in FIG. 4, wherein the engagement means (56) positions the scoop utensil 28 on the tab 40, with the bowl portion 32 of the scoop positioned within the open area 42 of the body 26. The secondary securing of the utensil to the ring is contemplated to be removable and repeatable. Hence, the scoop may be removed, used to withdraw and/or measure product, and returned to the engaged position, with the scoop ready for reuse at a later time. A lid (shown, for example, in FIG. 5) may be used to cover the opening 18, including the insert 12 and its removably attached scoop, for storage of the product within the container 10.

Figure 5A:
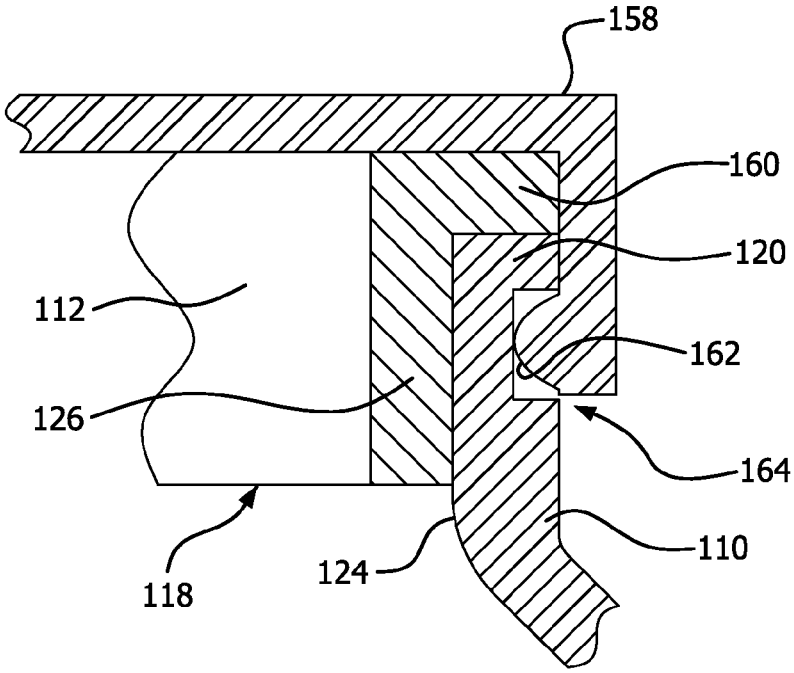
FIG. 5A is a partial cross-sectional view of the rim portion of the container and an insert structure of FIG. 5.
Figure 5:
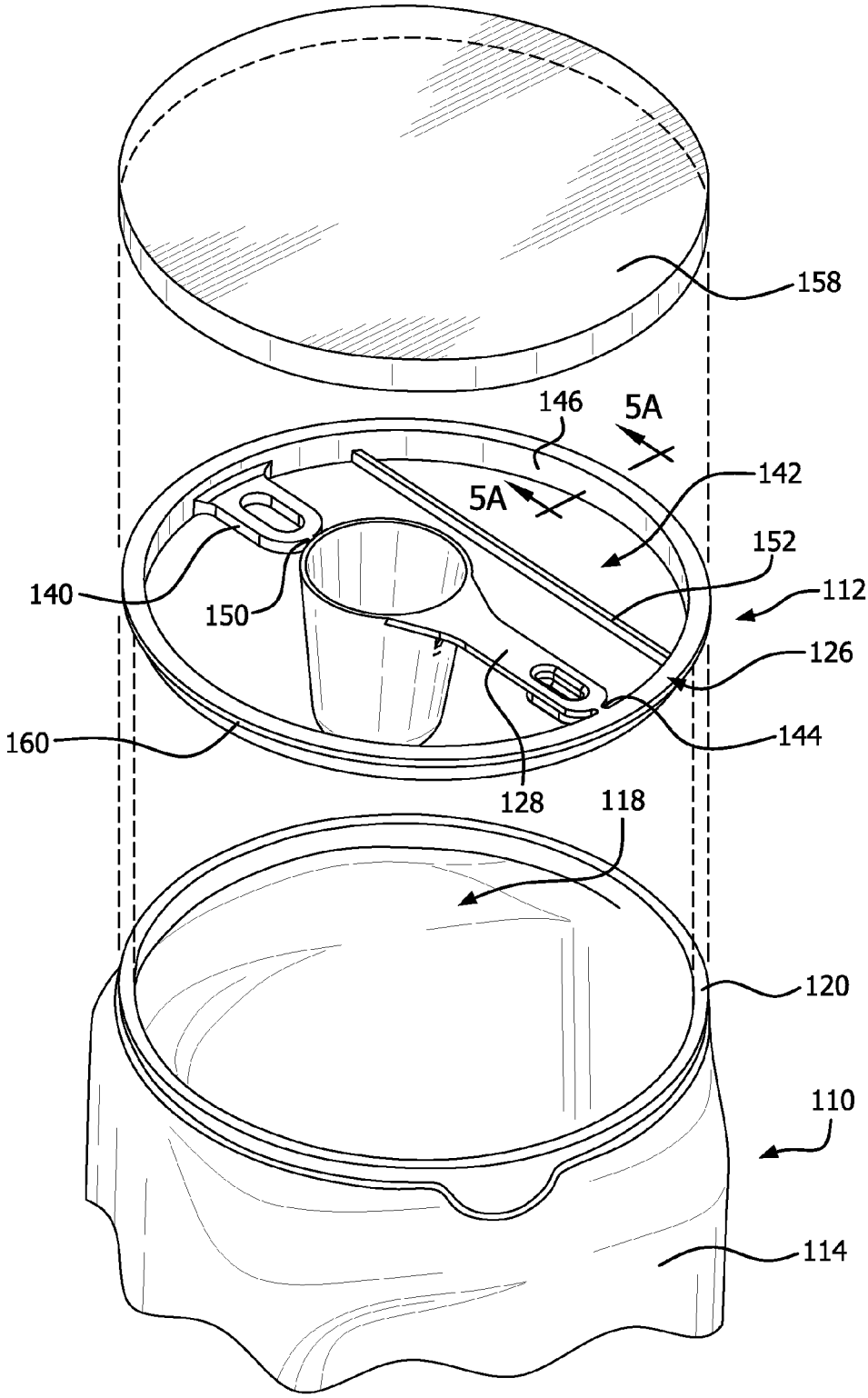
FIG. 5 is a perspective view of further embodiment of a container and an insert structure with the elements shown in an exploded position.

In FIG. 5, there is shown a variation of the container 100 and insert 112. The container 110 is shown as a molded structure, formed—for example—by a blow molding process. The container sidewalls 114 have generally rectangular form and transition at the top to define a generally circular opening 118. A round rim 120 defines the opening 118. It should be noted that in either embodiment, the opening into the container may have forms other than round. For example, a square or rectangular opening may be provided, with a corresponding form for the insert. In FIG. 5, the insert 112 is shown as having a ring-like body 126 having a defined central open area 142. A receiving tab 140 is formed on the inside wall 146 of the ring 126, with a scoop-like utensil 128 frangibly connected to the ring 126 at the sidewall 144 and the tab 150. A lid 158 is shown above the insert 112 and includes standard overcap-like structures of a central covering body and annular skirt.

The insert 112 includes a projecting rim 160 formed on the ring body 126. As shown in the partial cross-section of FIG. 5A, the insert 112 fits into the opening 118 defined by the rim 120 of the container 110. The ring 126 is closely spaced with the inside wall 124 of the rim 120. The projecting rim 160 on the ring 126 fits over the rim 120 of the container 110 to fix the position the insert 112 within the opening 118. The insert 112 may be secured to the rim 120 of the container 110 by means of friction, an adhesive, ultrasonic welding, etc. The lid 158 overlaps the insert 112 and the container rim 120, with an inward bead 162 on the skirt portion of the lid 158 engaged within a groove 164 formed in the outside wall of the container 110. A receiving shoulder (not shown) may be provided in the upper surface of the container rim 120 to receive the projecting rim 160 or the insert 112 such that a continuous rim surface is created across the top of the insert and the container.

Figure 6:
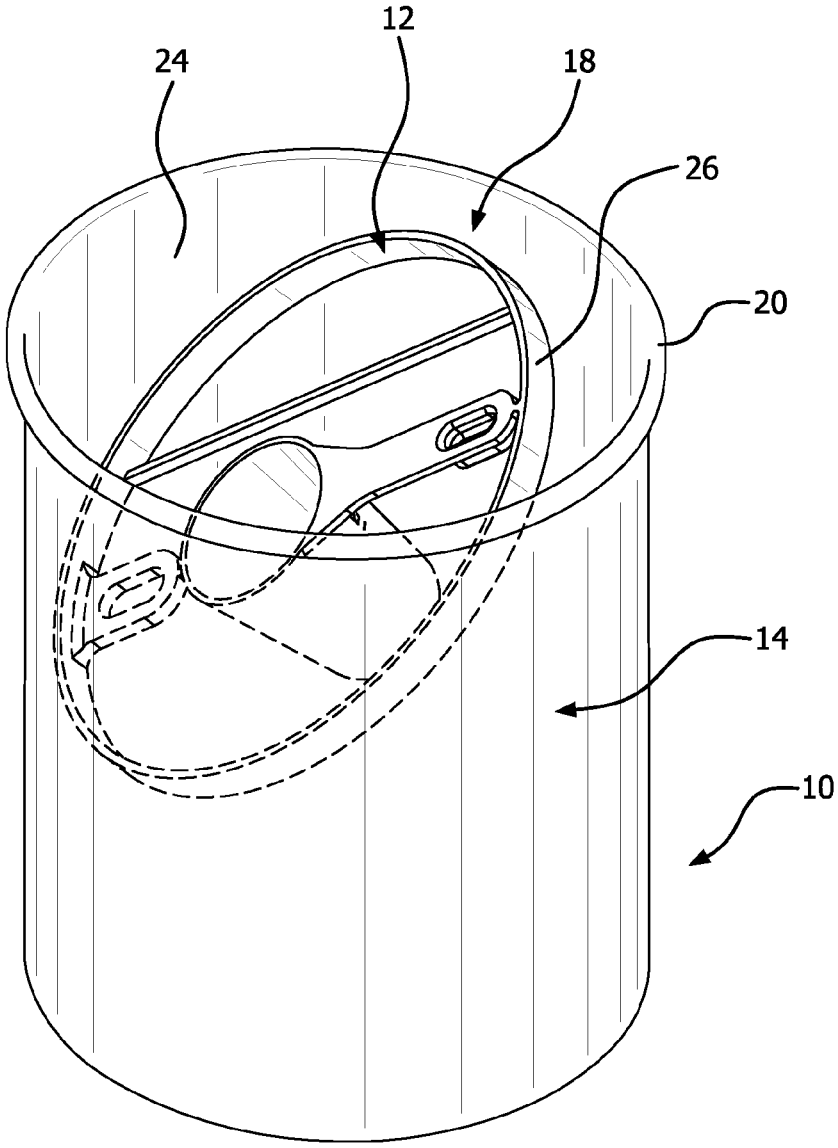
FIG. 6 is a perspective view of a further assembly of a container and an insert structure.

In FIG. 6, a representative insert 12 of the form shown in FIG. 1 is positioned within the internal volume of the container 10, which is defined by the sidewall 14. The insert 12 is positioned below the rim 20 and the top opening 118. The body 26 is dimensioned to fit within the opening 18 and within the inside surface of the sidewall 14. The ring form of the body 26 may be elongated to create a friction fit, with the insert 12 angled within the inside volume and generally fixed in position for access and use.

Figure 7:
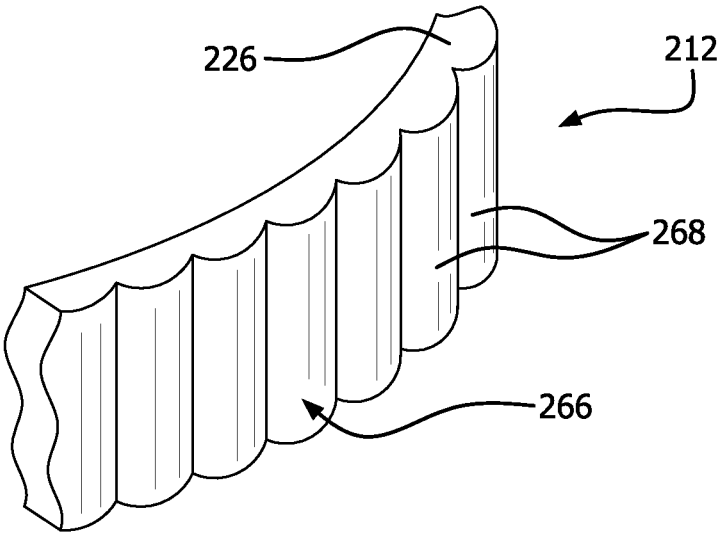
FIG. 7 is a partial perspective view of a portion of an alternate body portion for an insert structure.

In FIG. 7, there is shown a portion of the body 226 of an insert 212, which may have the same form and structure as the insert 12 (or 112) as previously described. The outside wall 266 of the insert 212 is provided with a friction-creating surface in the form of bumps or ridges 268. It is contemplated that other surface structures may be used to add to the overall frictional engagement by the insert with the inside wall (or similar surface) within the opening of a container.

Figure 8:
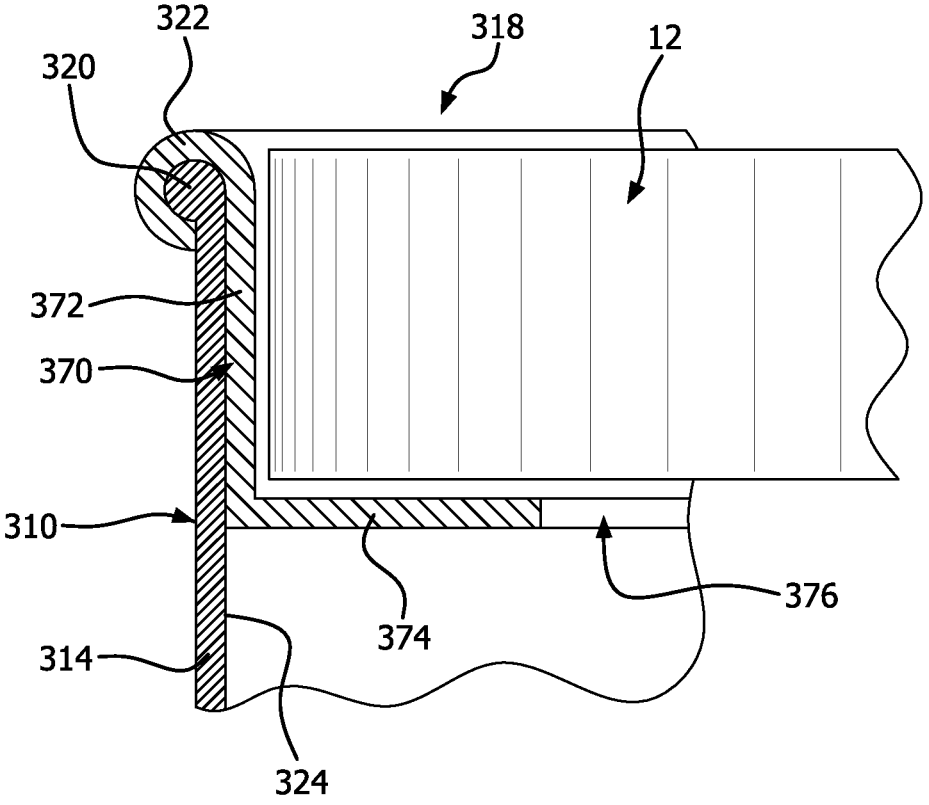
FIG. 8 is a partial sectional view of rim portion of a container and an insert structure.

In FIG. 8, there is shown an insert, such as the insert 12 of FIG. 1, positioned within a container opening 318 defined by a closure rim 370 that is secured to the rim 320 of the container 310. The closure rim 370 is shown as a separate member that is crimped to the container rim 320, forming a rounded bead 322 at the top end of the sidewall 314. An internal wall 372 extends along the inside wall 324 of the container and ends in an inwardly projecting flange 374. The flange 374 forms an access opening 376 for the internal volume of the container. A removable membrane seal (not shown) may be secured to the flange 374 to seal the access opening 376 prior to initial access to the product stored in the container. Alternatively, a membrane seal may be secured to the bead 322 of the closure rim 370.

The insert is positioned on the flange 374 and rests within the area defined by the internal wall 372, above the flange 374. The insert 12 maybe frictionally retained by the closure rim 370 or may be loosely positioned on the flange 374. It is contemplated that the tab and utensil on the insert will be formed without interference with the flange 374 (or a provided membrane). For example, the bowl portion of the scoop is contemplated to fit within the defined area or otherwise not be obstructed by flange (or membrane).

In the forms shown, the utensil is a scoop having certain useful structures. Other utensils for use with the product retained within a container may also be included on the insert structure. In addition, the frangible connection of the utensil to the body of the insert may also be varied in creating the insert. Variations in the form of a container are also possible, including different shapes for the sidewalls and the opening. Further, the opening into the container is shown at the top end of the container, but may be otherwise positioned. Variations in the form of an overcap or other closure are further possible.

The present disclosure shows and describes one or more exemplary embodiments. It should be understood by those skilled in the art from the foregoing that various other changes, omissions and additions may be made therein, without departing from the spirit and scope of the contemplated invention, with the scope of the invention being defined by the foregoing claims.

What is claimed is:

1. An insert for a container, the container having an interior where a product may be stored and an opening therein for providing access to the product, the opening defined by a peripheral rim having an internal sidewall, the insert comprising:

a body defining an outer periphery and an internal open area, the outer periphery having a dimension defined for receipt within the internal sidewall of the container rim, the body is formed as a ring, the ring having an outside sidewall defining the outer periphery and having an inside wall the internal open area defined there between, a utensil frangibly connected to the inside wall of the ring within the internal open area of the body, the utensil initially extending across at least a portion of the open area, and a receiving tab projecting from the inside wall of the ring and projecting, inwardly into the open area, frictional engagement means formed on the utensil and on the receiving tab, the engagement means for removably securing the utensil to the receiving tab, wherein the utensil is initially frangibly connected to the inside wall of the ring of the body within the open area and the frangible connection accommodates a structural rupture of the connection between the body and the utensil in response to application of a sufficient force to the utensil for removal of the utensil from the body, and wherein the utensil is secondarily secured within the open area defined by the body to the receiving tab by the frictional engagement means and the utensil is removably secured to the inside wall of the ring and stored in the open area defined by the body after removing the frangible connection of the utensil and the body.

2. The insert as in claim 1 wherein the utensil comprises a scoop having a handle portion and a utility portion in the form of a bowl.

3. The insert as in claim 2 wherein the bowl is defined by a top opening having a defined lip, tapered sidewalls, and a bottom surface.

4. The insert as in claim 1 wherein the utensil is frangibly connected at two spaced locations along the inside wall of the body.

5. The insert as in claim 1 wherein the utensil comprises a handle portion and a utility portion, the handle portion extending from the utility portion and the two defining a linear length of the utensil.

6. The insert as in claim 1 wherein the linear length of the utensil is substantially equal to a transverse dimension of the open area of the body, such that the utensil extends across the open area and is frangibly connected at opposite ends to the body.

7. The insert as in claim 1 wherein the utensil is frangibly connected to the inside wall of the ring of the body at one end and frangibly connected to the receiving tab at an opposite end.

8. The insert as in claim 7 wherein the body, tab and utensil are integrally molded from a polymeric material.

9. The insert as in claim 8 wherein each of the frangible connections comprises a reduced cross-sectional thickness of said polymeric material between the utensil and the connection to the body.

10. The insert as in claim 1 wherein in the frictional engagement means comprises a projecting tag and a receiving opening, the projecting tag formed for frictional engagement within the receiving opening.

11. The insert as in claim 10 wherein the receiving opening is formed on the receiving tab and the projecting tag is formed on the utensil.

12. The insert as in claim 1 further comprising a projecting rim portion extending outwardly from the outside wall of the ring, the rim portion adapted to engage the peripheral rim of the container for positioning the body within the container opening.

13. The insert as in claim 12 wherein the ring formed by the body has a circular form.

14. The insert as in claim 1 wherein the outside wall further comprises frictional ribs for engagement of the body with the internal wall of the opening of the container.

15. An insert for a container, the container having an interior where a product may be stored and an opening therein for providing access to the product, the opening defined by a peripheral rim having an internal sidewall, the insert comprising:

a body defining an outer periphery and an internal open area, the outer periphery having a dimension defined for receipt within the internal sidewall of the container rim, a utensil frangibly retained on the body within the internal open area, the utensil initially extending across at least a portion of the open area, and a receiving tab projecting from the body into the open area, a leveling bar connected to the body and extending across the open area, the leveling bar positioned adjacent the utensil, frictional engagement means formed on the utensil and the receiving tab, the engagement means for removably securing the utensil to the receiving tab, wherein the utensil is initially frangibly connected to the body and the frangible connection accommodates a structural rupture of the connection between the body and the utensil in response to application of a sufficient force to the utensil for removal of the utensil from the body, and wherein the utensil is secondarily secured to the receiving tab by the frictional engagement means and the utensil is removably stored in the open area defined by the body.

16. An insert and container combination, comprising:

a container defined by a sidewall, a bottom wall and an opening surrounded by an upper rim, the sidewall and bottom wall defining an interior volume where a product may be stored and the opening providing access to the product within the interior volume; and an insert ring comprising a substantially planer body defining an outer periphery of the ring and an internal open area, the outer periphery having a dimension defined for receipt of the body within the container rim and for frictional engagement of the insert ring within the opening of the container adjacent the upper rim, a scoop frangibly secured within the open area and aligned within the plane of the body, the scoop initially extending across at least part of the open area, the scoop comprising a handle portion projecting from a peripheral lip of an open bowl portion, and a receiving tab formed as part of the body of the insert ring and projecting into the open area within the plane of the body, frictional engagement means formed on the scoop handle and on the receiving tab, the frictional engagement means for cooperative and removable securing of the scoop to the receiving tab, wherein the scoop is initially frangibly connected to the body within the open area and within the plane of the body, the frangible connection accommodates a structural rupture of the connection of the scoop with the body in response to application of a sufficient force to the scoop, and wherein the scoop is secondarily secured in the open area and within the plane of the body to the receiving tab by activation of the frictional engagement means on the scoop handle with the frictional engagement means on the receiving tab.

17. The insert and container as in claim 16 wherein the scoop is frangibly connected to the insert body at two spaced locations.

18. The insert and container as in claim 16 wherein the body, tab and scoop are integrally molded from a polymeric material.

19. The insert and container as in claim 18 wherein each of the frangible connections comprises a reduced cross-sectional thickness of said polymeric material between the scoop and the connection to the insert body.

20. The insert and container as in claim 16 wherein one of the frangible connections of the scoop to the insert body is a connection to the receiving tab.

21. The insert and container as in claim 16 wherein in the frictional engagement means comprises a projecting tag and a receiving opening, the projecting tag formed for frictional engagement within the receiving opening.

22. The insert and container as in claim 21 wherein the receiving opening is formed on the receiving tab and the projecting tag is formed on the handle of the scoop.

23. The insert and container as in claim 16 wherein the upper rim of the container defines a circular opening and the insert body is formed as a circular ring, the circular ring having an outside sidewall defining the outer periphery, wherein the outside sidewall engages the container rim to secure the insert ring in the opening, and the circular having an inside wall defining the open area, wherein the scoop is frangibly secured to the inside wall and the receiving tab projects inwardly from the inside wall.

24. The insert and container as in claim 23 wherein the insert further comprises a projecting rim portion extending outwardly from the outside wall, the projecting rim portion adapted to engage the upper rim of the container with the insert body positioned within the container opening.

25. The insert and container as in claim 23 wherein the outside wall further comprises frictional ribs for frictional engagement of the inside surface of the rim of the container.

26. The insert and container as in claim 16, further comprising an overcap for engaging the upper rim of the container and for closing the container opening, the overcap covering the insert positioned within the container.

27. The insert and container as in claim 16, further comprising a closure rim secured to the upper rim of the container and having an inwardly directed flange thereon, the insert positioned on the flange within the opening of the container.

28. An insert and container combination, comprising:

a container defined by a sidewall, a bottom wall and an opening surrounded by an upper rim, the sidewall and bottom wall defining an interior volume where a product may be stored and the opening providing access to the product; and an insert comprising a planer body defining an outer periphery and an internal open area, the outer periphery having a dimension defined for receipt of the body within the container rim, a scoop frangibly secured within the plane of the body, the scoop initially extending across at least part of the open area, the scoop comprising a handle portion projecting from a peripheral lip of an open bowl portion, the scoop is initially frangibly connected to the body within the open area, a receiving tab projecting into the open area within the plane of the body, frictional engagement means formed on the scoop handle and on the receiving the engagement means for cooperative and removable securing of the scoop to the receiving tab, and a leveling bar connected to the body and extending across the open area, the leveling bar positioned adjacent and parallel to the scoop in its initial position, wherein the frangible connection accommodates structural rupture of the connection of the scoop in response to application of a sufficient force to the scoop, and wherein the scoop is secondarily secured in the open area to the receiving tab by activation of the frictional engagement means.

* * * * *